US009149829B2

(12) United States Patent
Gill

(10) Patent No.: US 9,149,829 B2
(45) Date of Patent: Oct. 6, 2015

(54) ADJUSTABLE INSIDE APPLICATOR

(71) Applicant: Tape-Pro Drywall Tools Pty Limited, Queensland (AU)

(72) Inventor: Thomas Charles Gill, Queensland (AU)

(73) Assignee: Tape-Pro Drywall Tools Pty Limited, Queensland (AU)

( * ) Notice: Subject to any disclaimer, the term of this patent is extended or adjusted under 35 U.S.C. 154(b) by 294 days.

(21) Appl. No.: 13/855,245

(22) Filed: Apr. 2, 2013

(65) Prior Publication Data

US 2014/0294480 A1 Oct. 2, 2014

(51) Int. Cl.

| | |
|---|---|
| ***A46B 17/02*** | (2006.01) |
| ***B05C 11/00*** | (2006.01) |
| ***B05C 5/00*** | (2006.01) |
| ***E04F 21/08*** | (2006.01) |
| ***E04F 21/165*** | (2006.01) |
| *B05C 17/005* | (2006.01) |

(52) U.S. Cl.

CPC . *B05C 11/00* (2013.01); *B05C 5/00* (2013.01); *E04F 21/08* (2013.01); *E04F 21/1655* (2013.01); *B05C 17/00516* (2013.01)

(58) Field of Classification Search

CPC ..... E04F 21/06; E04F 21/1655; B05C 11/02; B05C 17/0516

USPC ..... 401/9–11, 48, 143; 15/235.4; 425/87, 425/458

See application file for complete search history.

(56) References Cited

U.S. PATENT DOCUMENTS

| | | | | |
|---|---|---|---|---|
| 2,824,443 | A * | 2/1958 | Ames | 425/87 |
| 6,155,809 | A * | 12/2000 | Edwards et al. | 425/87 |
| 6,869,492 | B1 * | 3/2005 | Kooistra | 156/71 |
| 7,114,869 | B2 * | 10/2006 | MacMillan | 401/5 |
| 8,628,318 | B1 * | 1/2014 | Jalbert | 425/87 |

* cited by examiner

*Primary Examiner* — Jennifer C Chiang
(74) *Attorney, Agent, or Firm* — The Webblaw Firm

(57) ABSTRACT

An adjustable inside applicator including an attachment body to attach the applicator to a source of compound to be applied to a joint, the attachment body having a bore including an inlet and at least two outlets, a pair of faces angularly disposed relative to one another with at least one outlet located in each of the pair of faces, and a pair of floating application guide heads mounted pivotably to the attachment body and biased towards a straight angle between the floating application guide heads but movable against the bias into an angle which is less than straight, each floating application guide head having an opening therein in communication with a respective at least one outlet of the body.

19 Claims, 7 Drawing Sheets

ADJUSTABLE INSIDE APPLICATOR

TECHNICAL FIELD

The present invention relates to hand tools generally and in particular to a hand tool to apply joint compound to a joint with an interior angle between surfaces.

BACKGROUND ART

The tools conventionally available for the application of joint compound to a joint with an interior angle between two surfaces include an application hand with a pair of lateral portions which are at a fixed angle relative to one another with that angle matching the angle between the two surfaces. A container or compound tube of joint compound is typically attached to the head and a channel is provided from the opening of the container to an outlet relative to each of the lateral portions to apply the joint compound to both sides and the apex of an internal angle between two surfaces when a horizontally or vertically prior to applying paper tape by hand.

The surfaces to which the joint compound is applied are rarely finished with sufficient precision that the application of the joint compound requires no touchup work after application. Normally, at least some touchup work is required in order to ensure that all surfaces and sometimes the apex of the internal angle are properly covered with joint compound to allow the paper tape to adhere properly.

Existing applicator devices are available which apply the compound but only to walls at angles of either 90° to one another or 135° to one another. Splayed internal walls are quite often not at either of these angles and the angle between two walls may differ substantially.

It will be clearly understood that, if a prior art publication is referred to herein, this reference does not constitute an admission that the publication forms part of the common general knowledge in the art in Australia or in any other country.

SUMMARY OF INVENTION

The present invention is directed to an adjustable inside applicator, which may at least partially overcome at least one of the abovementioned disadvantages or provide the consumer with a useful or commercial choice.

With the foregoing in view, the present invention in one form, resides broadly in an adjustable inside applicator including an attachment body to attach the applicator to a source of compound to be applied to a joint, the attachment body having a bore therethrough including an inlet and at least a pair of outlets, at least one outlet located in each of a pair of faces which are angularly disposed relative to one another, and a pair of floating application guide heads mounted pivotably to the attachment body and biased towards a maximum angle between the floating application guide heads but movable against the bias into an angle which is less than the maximum, each floating application guide head having an opening therein in communication with a respective at least one outlet of the body.

In an alternative aspect, the present invention resides in an adjustable inside applicator including an attachment body to attach the applicator to a source of compound to be applied to a joint, the attachment body having a bore including an inlet and at least two outlets, a pair of faces angularly disposed relative to one another with at least one outlet located in each of the pair of faces, and a pair of floating application guide heads mounted pivotably to the attachment body and biased towards a maximum angle between the floating application guide heads but movable against the bias into an angle which is less than the maximum angle, each floating application guide head having an opening therein in communication with a respective at least one outlet of the body.

In the context of the present specification, the adjustable inside applicator is adapted to apply compound to a joint, by which it is meant that the compound is preferably applied to planar portions of wall beside the apex of the joint, rather than to the entirety of the joint including the apex. This may allow a flexible bead or similar to be positioned at the apex in order to allow for expansion between the two wall portions through movement of the flexible bead. If compound is applied over the top of a flexible bead, there will likely be cracking of the compound when the flexible bead flexes. This can be minimised or avoided by applying the joint compound beside the apex but not over the apex or flexible bead.

The adjustable inside applicator of the present invention is provided to apply a settable or curable compound commonly known as "joint compound" at or adjacent the joint in between two surfaces. Typically, the inside angle for which the applicator is used, is an angle of less than 180° or a straight angle between two walls or surfaces that meet at a joint. An angle of greater than 180° requires an outside applicator and at a straight angle or 180°, a flat trowel or similar can be used. Normally, the applicator of the present invention will be used to apply joint compound to a joint between two plasterboard or similar board walls at or around the joint where the boards should meet.

Usually, the joint is coated prior to applying a splayed or adjustable corner bead which is typically applied into the gap between the two boards. The conventionally available inside applicator devices have an angle which is fixed at either 90° or 135° thereby limiting their use in situations where boards or walls meet each other at angles which are other than 90° or 135°.

The inside applicator of the present invention is normally fixed to a compound tube which is used to either draw compound from a container or to store a portion of compound within the compound tube for application.

The inside applicator of the present invention can be used in any orientation, that is can be used substantially vertically, substantially horizontally, or at any angle where two walls or boards meet at a join.

The device of the present invention is preferably used to apply a ribbon of joint compound on either side of the apex of the join. The device may apply joint compound to the apex of the join but preferably, this particular portion is left free of compound in order to allow a flexible bead to be positioned within the apex to allow for expansion so that the flexible bead can move. Typically, the device of the present invention will apply the joint compound on planar portions of the board on either side of the apex rather than at the apex.

The device of the present invention includes an attachment body to attach the applicator to a source of compound to be applied to a joint, the attachment body having a bore including an inlet and at least two outlets, a pair of faces angularly disposed relative to one another with at least one outlet located in each of the pair of faces.

The attachment body preferably has an attachment portion and a pair of application faces which are located in a guide head portion of the attachment body which is spaced from the attachment portion. The application faces are preferably angled relative to one another. Typically, the angle will be greater than 90° but less than 180°. According to the most preferred embodiment, the angle between the application faces is approximately 100°.

The attachment body will normally be unitary with a bore extending through the body, the bore preferably being unitary adjacent the inlet and divided into at least a pair of bore portions which each lead to an outlet from the attachment body. As mentioned above, the attachment body will normally have an attachment portion and a guide head portion, which are typically separated by a neck portion.

The attachment portion may have any shape but is preferably of rectangular cross-section. The attachment portion will typically have an attachment face which is substantially rectangular and it is adapted to attach the attachment body to existing tools or compound tube. An attachment mechanism or assembly is provided on the attachment portion in order to attach to an existing tool or compound tube.

Typically the attachment face includes an inlet to the bore through the attachment body. This portion of the bore is typically unitary and at least a portion of the bore is preferably shaped to receive a portion of a compound tube. Usually, the attachment mechanism includes a partially circumferential groove to receive a circlip or similar device to attach the releasably compound tube to the attachment body. Generally, a portion of the compound tube is inserted at least partially into the unitary portion of the bore and temporarily fixed there.

An external portion of the attachment portion of the attachment body will normally also be provided with a mounting assembly in order to mount one or more biasing members or structures in order to bias the floating application heads towards the maximum angle. Normally, the maximum angle is an angle slightly less than a straight angle or 180°.

The attachment portion will normally have an upper portion above the rectangular cross-section lower portion, which is generally trapezoidal in cross-sectional shape. This generally trapezoidal cross-sectional shape upper portion will provide a pair of external surfaces or shoulders into which or relative to which a mount for the biasing member or structure is provided.

As mentioned above, a narrowed or neck portion is located above the attachment portion and which attaches the attachment portion to the guide head portion of the body. Generally, the bore is unitary through the attachment portion of the body and also into or through the neck of the body. The bore preferably divides into at least two bore portions at or just above the neck, with one bore portion leading to each outlet located in or through each application face.

The guide head portion of the attachment body is preferably provided with a hinge point at the end opposite the attachment face. The hinge point is provided to allow rotation or pivoting of the guide heads about that point either under the biasing force or against the biasing force.

Typically, the hinge point is provided approximately centrally across the attachment body and further, the hinge point preferably extends across the body. Normally, the hinge point will be aligned with the apex of the joint in use. The hinge point may therefore be shaped to be received at least partially within the apex of the joint. Typically, the hinge point will be shaped to allow minimal resistance when traversing the apex of the joint. This will normally involve the hinge point being rounded at least to some degree.

Generally, the hinge point will be configured as one or more portions having an opening therethrough to receive a hinge pin which is preferably used to both attach the guide heads relative to the guide head portion of the attachment body and also to allow the guide heads to pivot about the hinge point.

The guide head portion of the attachment body will preferably be provided with the pair of application faces which each has at least one shaped outlet in communication with the divided bore portions. The particular configuration of the application faces is such that they are normally shaped to allow or encourage spreading or dispersion of the compound as it exits from an outlet of the bore. Generally, the outlet will be shaped in order to at least partially spread or disperse the compound over an area and the spreading or dispersion of the compound will be further assisted by the shape of the guide heads themselves.

The application faces are preferably generally rectangular. The application faces are also typically fixed at a different angle relative to one another. In use, the compound travels through the unitary bore portion in the attachment body and then is divided between the at least two bore portions to proceed to the outlet at each of the application faces of the body.

The applicator of the present invention also includes a pair of floating application guide heads mounted pivotably to the attachment body and biased towards a maximum (almost straight) angle between the floating application guide heads but movable against the bias into an angle which is less than the maximum angle, each floating application guide head having an opening therein in communication with a respective at least one outlet of the attachment body.

Each of the floating application guide heads is preferably of a plate or block configuration. Normally, each guide head has an opening therein and preferably entirely through the preferred plate or block configuration. The opening therefore preferably forms a bore through the plate or block with a continuous wall defining the length of the bore.

The preferred bore of the respective application guide heads communicates with a respective outlet in an application face of the attachment body. Preferably, the or each outlet in the application face of the attachment body will be located within the opening or bore through the preferred plate or block of the guide head.

The opening or bore in the application guide head will typically be substantially rectangular in order to allow the spreading or dispersion of the compound. Further, each opening will typically be substantially centrally located in the preferred plate or block. It is further preferred that each opening in the floating application guide heads is located in a depressed or rebated portion of the guide head. According to a particularly preferred embodiment, a pair of raised guide portions extends over each head substantially parallel to the hinge provided.

The pair of raised guide portions of each floating application guide heads will typically abut the surface of the board or wall on either side of the apex of the joint and the applicator of the present invention will therefore generally slide on the raised guide portions. The raised guide portions will therefore each typically have an abutment or sliding surface provided in order to abut a wall surface.

The pair of raised guide portions will preferably be parallel to one another and spaced apart so as to define the depressed or rebated section of the guide head between the pair of raised guide portions on each floating application guide head. As mentioned above, typically the or each opening is located in the depressed or rebated portion between the raised guide portions. The raised guide portions are preferably squared off in order to restrain or provide a lateral limit of flow of the compound exiting the outlet and which will also provide a neat finish for the compound strip. The respective ends of the depressed or rebated portion will be open in order to allow the applicator to be moved in a direction parallel to the hinge, generally in one direction to allow the compound to be dispersed or spread by translating the applicator over the join with the lateral limits of the spread of the compound defined by the pair of raised guide portions.

Normally, the raised guide portions are provided as one outer guide portion and one inner guide portion. The inner guide portion of each floating application guide head is typically located at or adjacent the apex of the joint. Therefore, the inner guide portion will normally be located adjacent the hinge point.

The abutment surfaces of each of a pair of guide portions are located in the same plane.

The depressed or rebated portion of each floating application guide head may be shaped in order to provide a particular shape to the compound strip which is dispensed using the applicator. For example, the compound strip may be substantially planar or may have a convex or concave cross-sectional shape depending upon the shape of the depressed or rebated portion. Preferably, the shape of the strip will be substantially planar in order to minimise wastage of the compound.

Normally the floating application guide heads are mounted to the attachment body at the hinge point allowing independent rotation or pivoting of the floating application guide heads about the hinge A biasing member or mechanism is preferably provided between the attachment body and each of the floating application guide heads. Typically, the biasing member or mechanism will be mounted relative to an underside of an outer portion of each floating application guide head.

Preferably, a mount or seat will be provided on the floating application guide head to mount the biasing member or mechanism and a corresponding mount or seat is provided on the attachment body. The configuration of the mount or seat will be dependent upon the nature of the biasing member or mechanism used. In its simplest form, the biasing member or mechanism will be or include a spring. According to this embodiment, a boss or shaped receiving opening may be provided on each side of the body and a corresponding boss or shaped receiving opening provided on each floating application guide head in order to seat the spring, minimising or preventing movement of the spring in any direction other than the compression or extension direction. This will also preferably act to minimise or prevent dislodgement of the spring at either end.

The biasing means may alternatively be or include a hydraulic of pneumatic rain containing a portion of fluid which can be compressed or moved between chambers to provide a biasing force.

The floating application guide heads are preferably movable between a maximum angle in which the angle between the plane or the abutment surfaces of each of the pair of guide portions is almost straight or almost 180°, and a minimum angle in which the depressed or rebated portion of the floating application guide heads is substantially coplanar with the respective application face of the attachment body. Typically, the minimum angle is approximately 100° and the maximum angle is approximately 160°.

Each guide head portion of the attachment body closely received within the opening in the respective guide heads such that compound exiting the outlet does not flow backwards between the guide head portion and the sides of the bore of guide head. Sealing may be provided to further prevent or limit this direction of flow.

An advantage of the spring loaded heads is that they adjust to the angle of the walls. If a fixed applicator head is used on a joint that is different to the angle of the head, it will result in leakage of joint compound and irregular application. If the joint is at anything other than 90° or 135° the compound would likely be applied by hand which is arguably slower.

The device of the present invention will typically be used to apply compound prior to fitting an internal corner bead, and not for any finishing operation.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
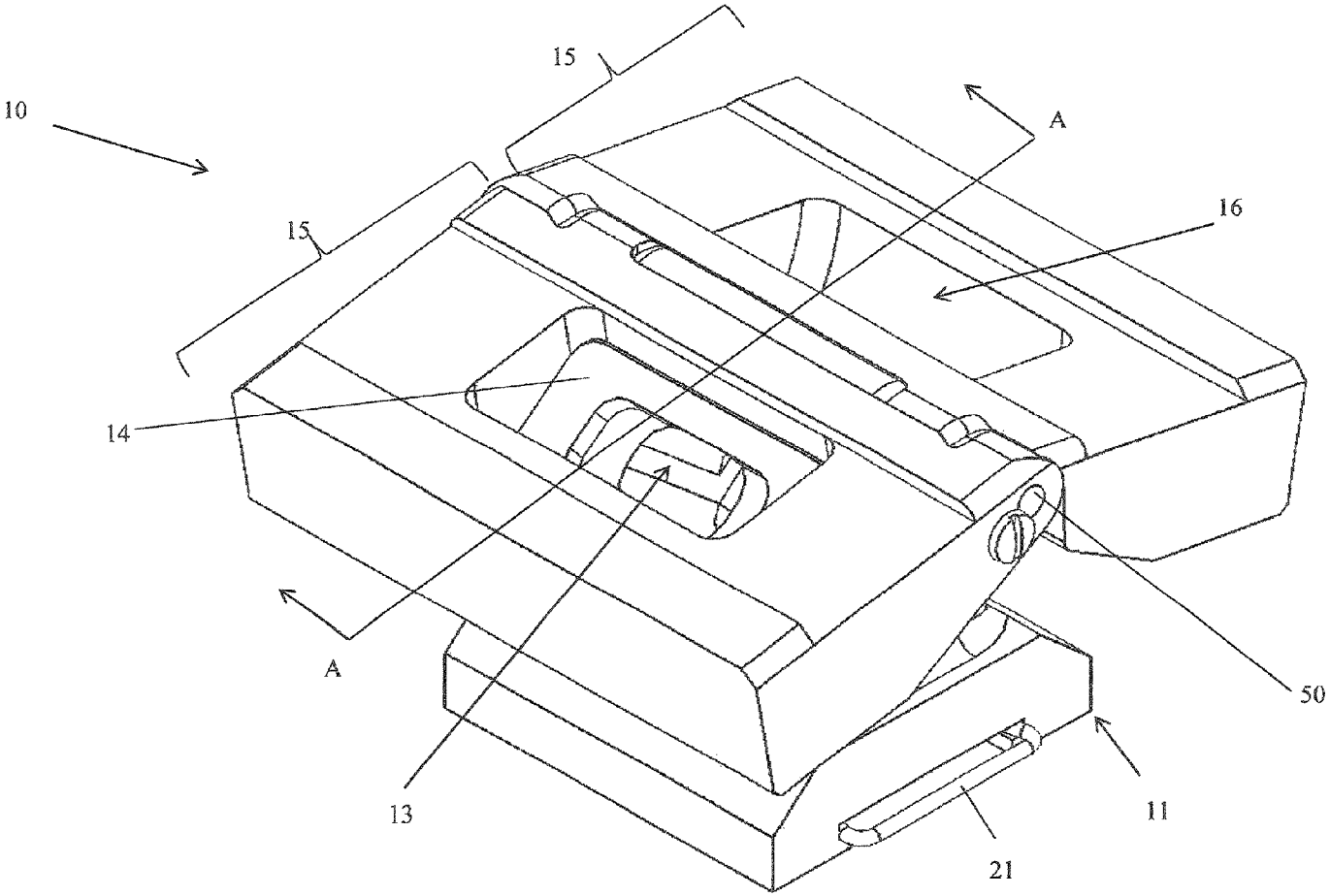
FIG. 1 is an isometric view of the adjustable inside applicator according to a preferred embodiment of the present invention.
Figure 2:
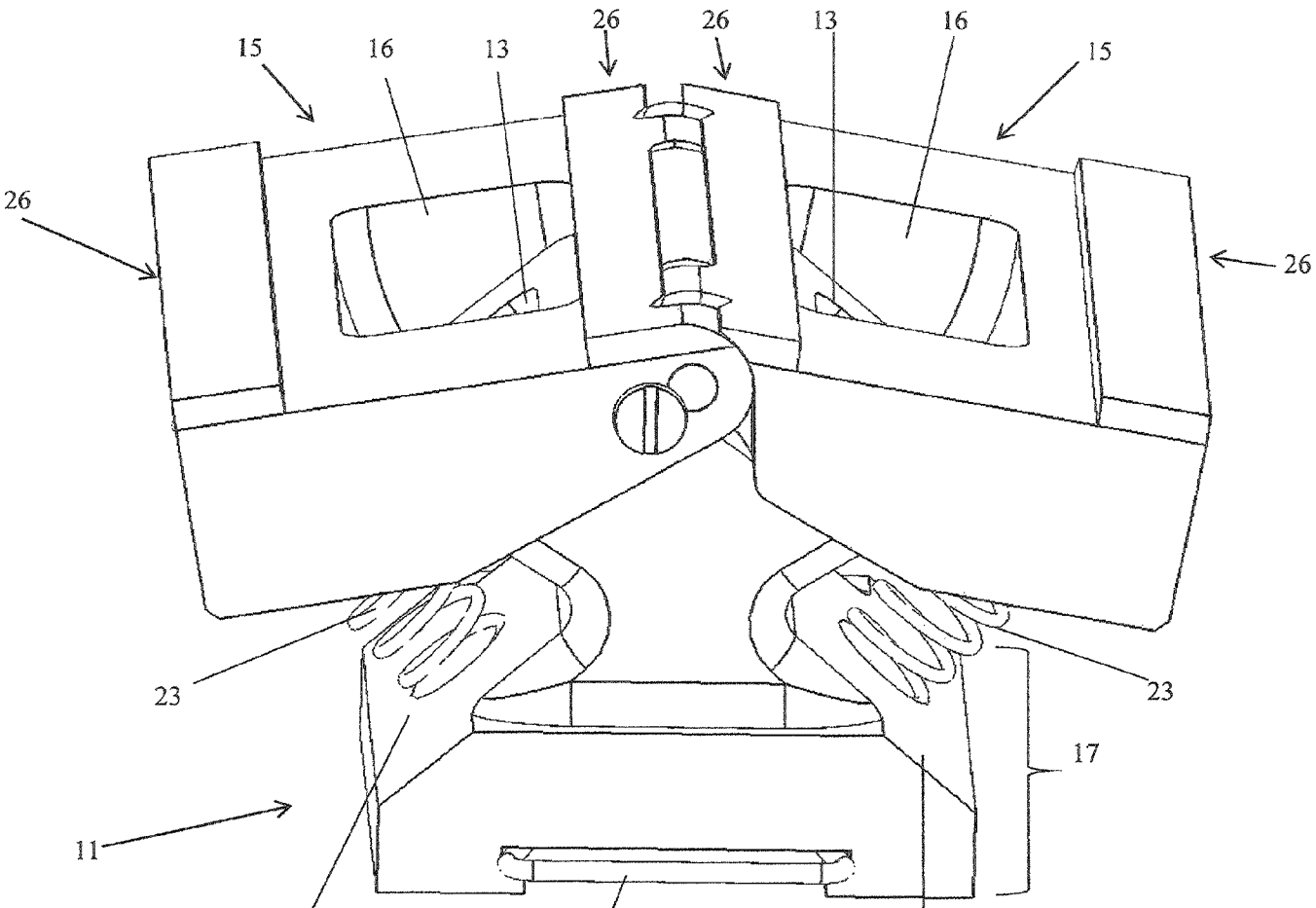
FIG. 2 is an axonometric view of the applicator illustrated in FIG. 1 with the application guide heads in the maximum angle position.
Figure 3:
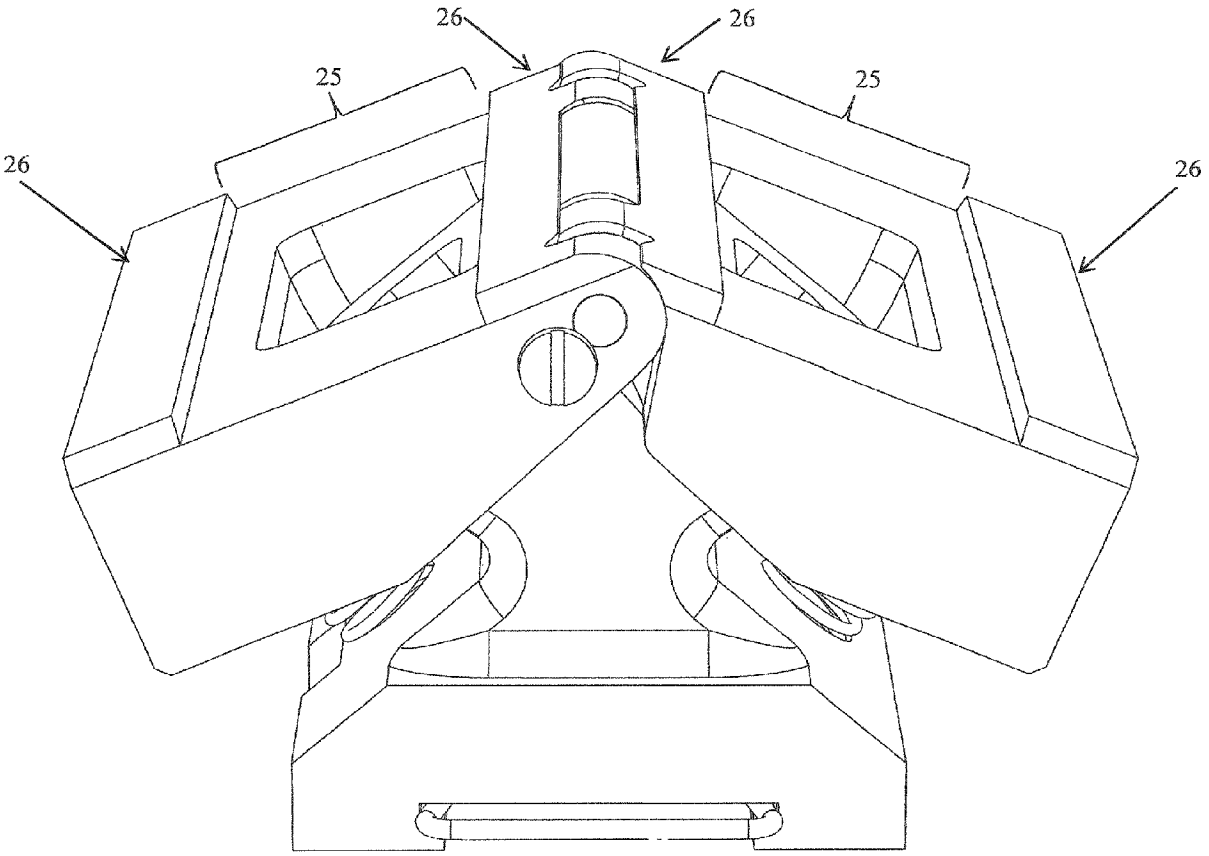
FIG. 3 is an axonometric view of the applicator illustrated in FIG. 1 with the application guide heads in an intermediate position.

According to a particularly preferred embodiment of the present invention, an adjustable inside applicator 10 for applying joint compound to a joint between two panels at an angle to one another is provided.

The adjustable inside applicator 10 of the illustrated embodiment includes an attachment body 11 to attach the applicator 10 to a source of compound to be applied to a joint, the attachment body 11 having a bore including an inlet 12 and at least two outlets 13, a pair of faces 14 angularly disposed relative to one another with at least one outlet 13 located in each of the pair of faces 14, and a pair of floating application guide heads 15 mounted pivotably to the attachment body 11 and biased towards a maximum angle between the floating application guide heads 15 but movable against the bias into an angle which is less than the maximum, each floating application guide head 15 having an opening 16 therein in communication with a respective at least one outlet 13 of the attachment body 11.

The inside applicator 10 is normally fixed to a compound tube (not shown) which is used to draw compound from a container or to store a portion of compound within the compound tube for application.

The preferred embodiment includes an attachment body 11 to attach the applicator 10 to a source of compound to be applied to a joint.

The attachment body 11 of the illustrated embodiment has an attachment portion 17 and a pair of application faces 14 which are located in a guide head portion 18 of the attachment body 10 which is spaced from the attachment portion 11. The application faces 14 are angled relative to one another and according to the most preferred embodiment, the angle between the application faces 14 is approximately 100°.

The attachment body of the illustrated embodiment is unitary with a bore extending through the body. The bore is unitary adjacent the inlet 12 and divides into a pair of bore portions 19 which each lead to an outlet 13 from the attachment body 11. As mentioned above, the attachment body 11 has an attachment portion 17 and a guide head portion 18, which are typically separated by a narrowed neck portion 20.

The attachment portion 17 is preferably of rectangular cross-section with a lower attachment face which is substantially rectangular and it is adapted to attach the attachment body 11 to a compound tube. An attachment mechanism or assembly is provided on the attachment portion in order to attach to an existing tool.

As illustrated, a portion of the bore is shaped to receive a portion of a compound tube. Usually, the attachment mechanism includes a partially circumferential groove to receive a circlip 21 or similar device to attach the compound tube to the attachment body. Generally, a portion of the compound tube is inserted at least partially into the unitary portion of the bore and temporarily fixed there.

The attachment portion 11 has an upper portion above the rectangular cross-section lower portion which is generally trapezoidal in cross-sectional shape. This generally trapezoidal cross-sectional shape upper portion provides a pair of external shoulders 22 into which or relative to which a mount for the biasing springs 23 is provided.

Figure 6:
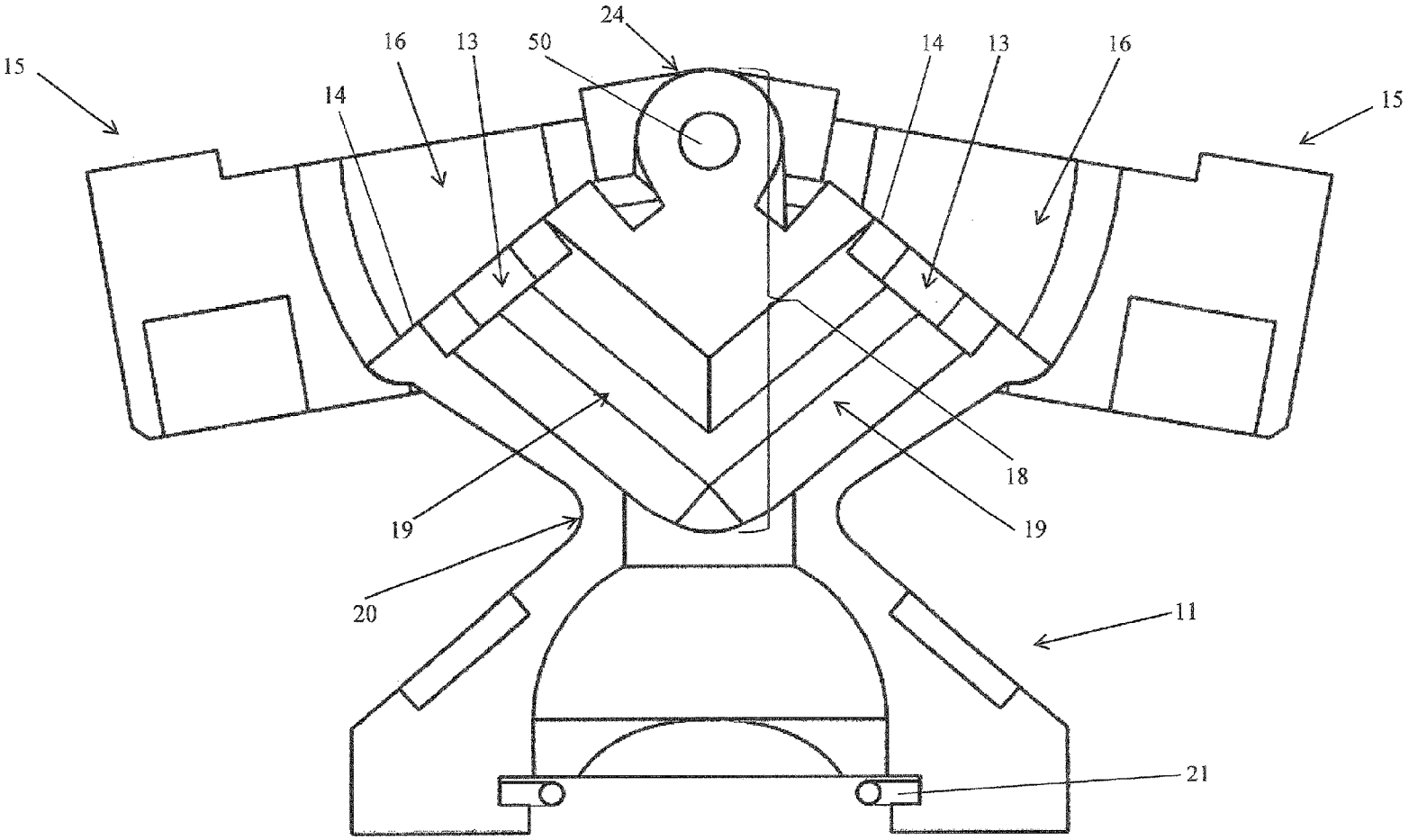
FIG. 6 is a line drawing of the configuration illustrated in FIG. 5.

As mentioned above, a narrowed neck portion 20 is located above the attachment portion 17 and which attaches the attachment portion 17 to the guide head portion 18 of the body 11. As illustrated in FIG. 6 in particular, the bore is unitary through the attachment portion of the body and also at least into the neck of the body. The bore then divides into two bore portions 19 at or just above the neck, with one bore portion 19 leading to each outlet 13 located in or through each application face 14.

The guide head portion 18 of the attachment body 11 is provided with a hinge 24 at the end opposite the attachment face to allow rotation or pivoting of the guide heads 15 about that hinge either under the biasing force or against the biasing force.

Typically, the hinge 24 is provided approximately centrally across the attachment body 11 and further, extends across the body 11. Normally, the hinge 24 is aligned with the apex of the joint in use and may therefore be shaped to be received at least partially within the apex of the joint. Typically, the hinge 24 will be shaped to allow minimal resistance when traversing the apex of the joint. This will normally involve the hinge 24 being rounded at least to some degree.

Generally, the hinge 24 will be configured as one or more portions having an opening therethrough to receive a hinge pin 50 which is used to both attach the guide heads 15 relative to the guide head portion 18 of the attachment body 11 and also to allow the guide heads 15 to pivot.

The guide head portions 15 of the attachment body are provided with a pair of application faces 14 which have shaped outlets 13 in communication with the divided bore portions 19. The particular configuration of the application faces 14 is such that they are normally shaped to allow spreading or dispersion of the compound as it exits from an outlet 13 of the bore. Generally, the outlet 13 is shaped in order to at least partially spread or disperse the compound over an area and the spreading or dispersion of the compound will be further assisted by the shape of the guide heads 15 themselves.

Figure 4:
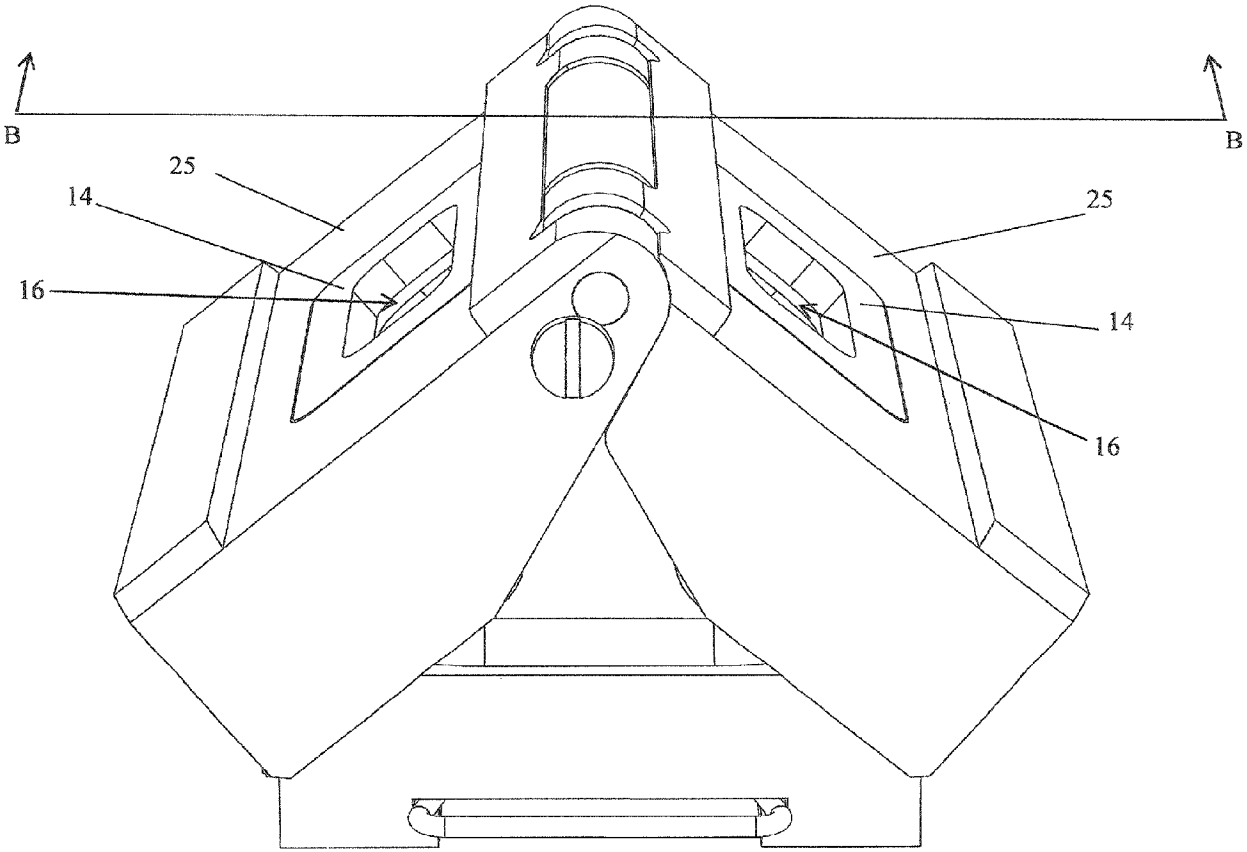
FIG. 4 is an axonometric view of the applicator illustrated in FIG. 1 with the application guide heads in the minimum angle position.

As best illustrated in FIG. 4, the application faces 14 are generally rectangular and fixed at an angle relative to one another. In use, the compound travels through the unitary bore portion in the attachment body 11 and then is divided between the two bore portions 19 to proceed to the outlet 13 at each of the application faces 14 of the body 11.

Each of the floating application guide heads 15 is of a plate or block configuration with an opening entirely through the preferred plate or block configuration. The opening 16 therefore forms a bore through the plate or block with a continuous wall defining the length of the bore.

According to the preferred embodiment illustrated, the outlet 13 in the application face 14 of the attachment body 11 is located within the opening 16 or bore through the preferred plate or block of the guide head 15.

Each guide head portion 18 of the attachment body 11 is closely received within the opening 16 in the respective guide heads 15 such that compound exiting the outlet 13 does not flow backwards between the guide head portion 18 and the sides of the opening 16 of the guide head 15. Sealing may be provided to further prevent or limit this direction of flow.

The opening or exit from the opening 16 in the application guide head 15 is substantially rectangular in order to allow the spreading or dispersion of the compound. Further, each opening 16 will is substantially centrally located in the preferred plate or block. It is further preferred that each opening 16 in the floating application guide heads 15 is located in a depressed or rebated portion 25 of the guide head. According to the illustrated preferred embodiment, a pair of raised guide portions 26 extends over each guide head 15 substantially parallel to the hinge 24 provided.

In use, the pair of raised guide portions 26 of each floating application guide heads 15 abuts the surface of the board or wall on either side of the apex of the joint and the applicator 10 of the present invention will therefore generally slide on the raised guide portions 26. The raised guide portions 26 have abutment or sliding surfaces provided on each, in order to abut a wall surface.

The pair of raised guide portions 26 are parallel to one another and spaced apart so as to define the depressed or rebated section 25 of the guide head 15 between the pair of raised guide portions 26 on each floating application guide head 15. As mentioned above, typically the opening 16 is located in the depressed or rebated portion 25 between the raised guide portions 26. As illustrated, the raised guide portions 26 are squared off in order to restrain or provide a lateral limit of flow of the compound exiting the outlet 13. The respective ends of the depressed or rebated portion 26 are open in order to allow the applicator 10 to be moved in one direction to allow the compound to be dispersed or spread by translating the applicator 10 over the join with the lateral limits of the spread of the compound defined by the pair of raised guide portions 26.

Normally, the raised guide portions are provided as one outer guide portion and one inner guide portion. The inner guide portion of each floating application guide head is typically located at or adjacent the apex of the joint. Therefore, the inner guide portion will normally be located adjacent the hinge 24.

The abutment surfaces of each of a pair of guide portions are located in the same plane.

Normally be floating application guide heads are mounted to the attachment body at the hinge 24 allowing independent rotation or pivoting of the floating application guide heads about the hinge. A biasing spring 23 is provided between the attachment body 11 and each of the floating application guide heads 15. Typically, the biasing spring 23 is mounted relative to an underside of an outer portion of each floating application guide head 15 as illustrated.

Figure 5:
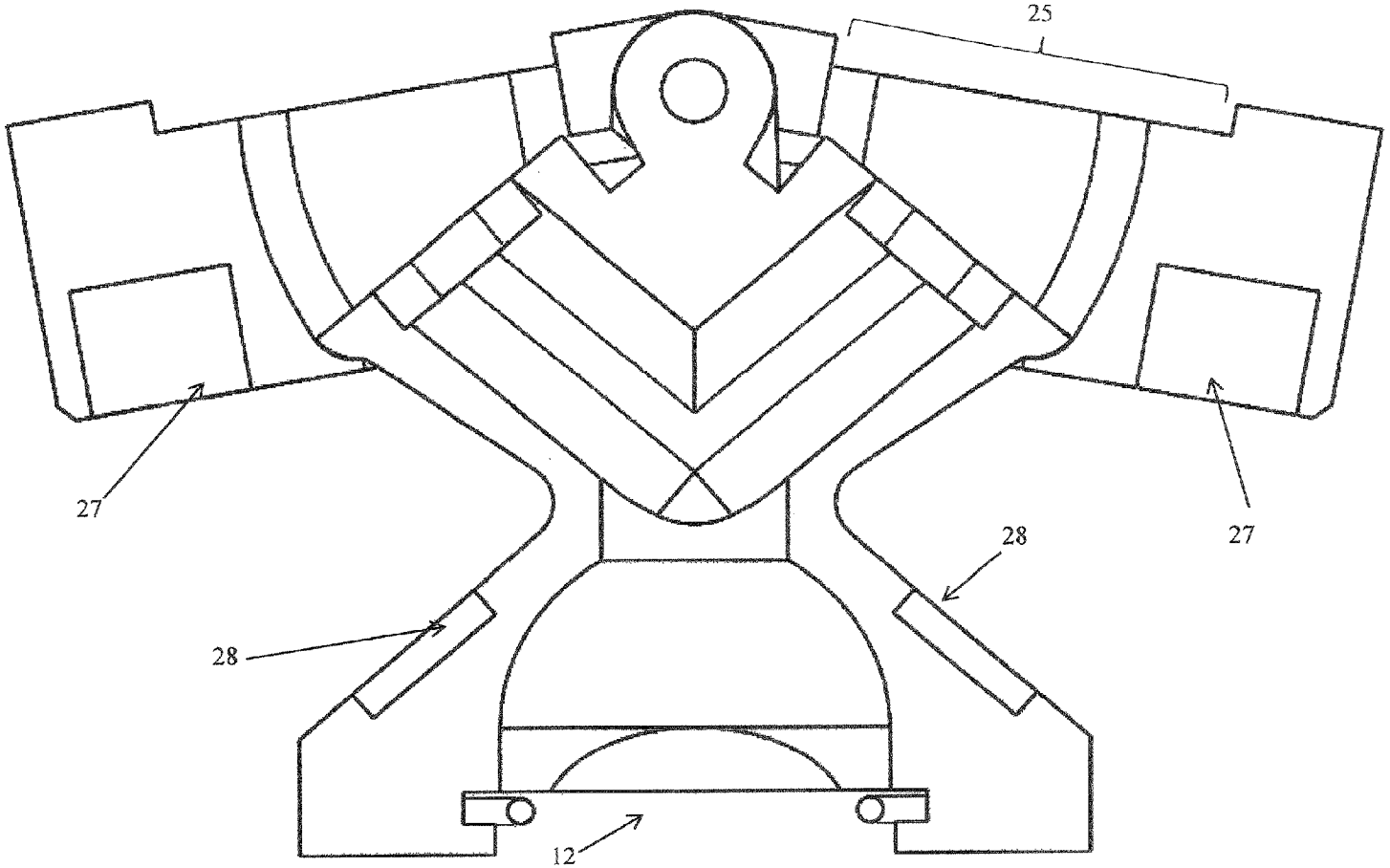
FIG. 5 is a sectional side view of the adjustable inside applicator illustrated in FIG. 1 along line A-A.
Figure 7:
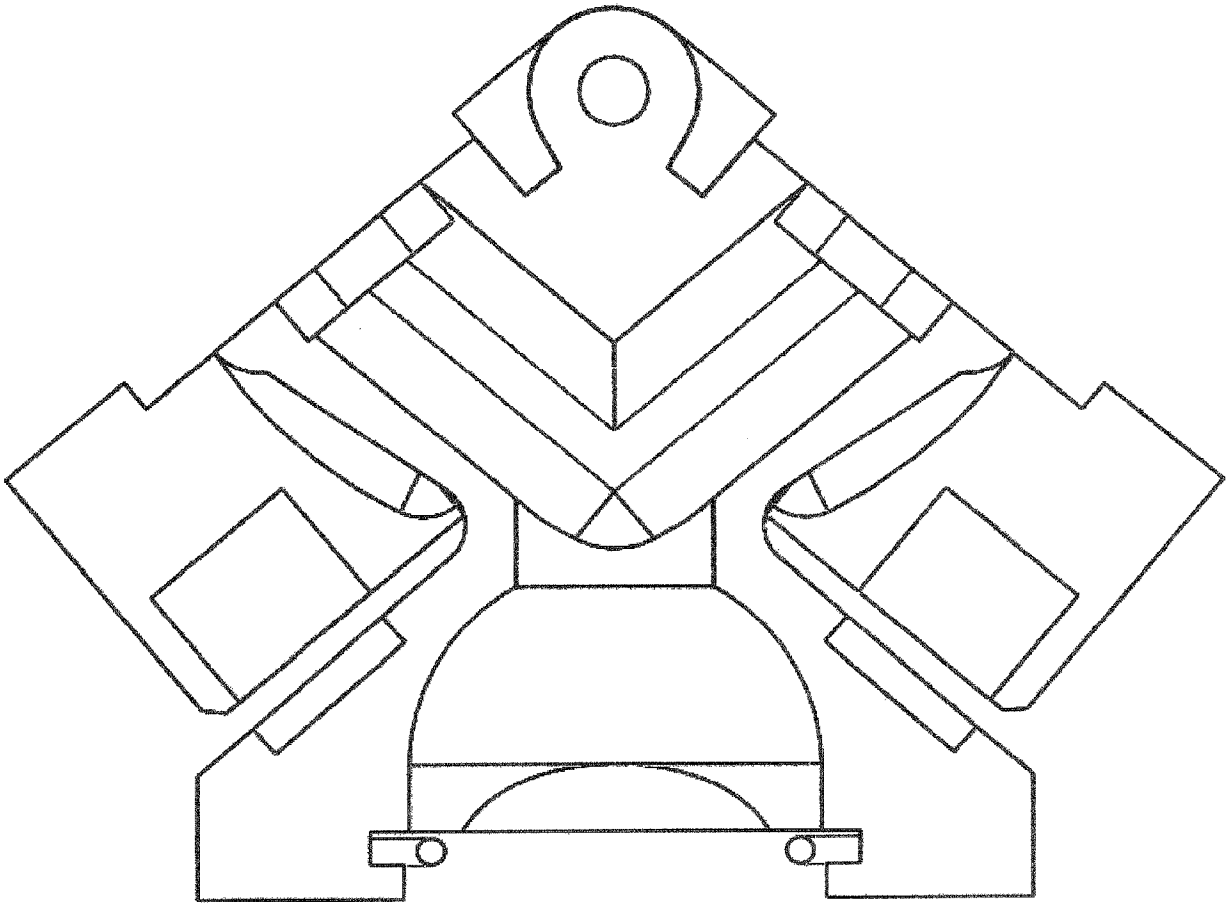
FIG. 7 is a sectional side view of the adjustable insight applicator illustrated in FIG. 4 along line B-B.

As illustrated best in FIGS. 5 to 7, a mount or seat 27 is provided on the floating application guide head 15 to mount the biasing spring and a corresponding meant mounting assembly in the form of a seat 28 is provided on the attachment body 11. In the illustrated embodiment, both mounts or seats are a shaped receiving opening in order to seat an end of the spring 23, minimising or preventing movement of the end of the spring and to minimise or prevent dislodgement of the spring at either end.

The floating application guide heads 15 are preferably movable between a maximum angle in which the angle between the plane or the abutment surfaces of each of the pair of guide portions is almost straight or almost 180° as illustrated in FIGS. 1, 5 and 6, and a minimum angle in which the depressed or rebated portion 25 of the floating application guide heads 15 is substantially coplanar with the respective application face of the attachment body as illustrated in FIGS. 4 and 7. Typically, the minimum angle is approximately 100° and the maximum angle is approximately 160°. Other intermediate angles are also possible by deformation of the springs to achieve the desired angle.

It is also anticipated that the applicator of the present invention can be provided in a one moving application guide head embodiment, that is with an application guide head on one side which is fixed rather than being movable and with a single movable application guide head on the other side. This embodiment will have some advantages in use in certain situations allowing a user to locate the fixed side relative to one of the surfaces to which the joint compound is to be applied and allow the movable application guide head on the other side to adjust to the angle of the other surface. This embodiment will produce the degrees of freedom of the device but will also decrease the complexity. For that reason, it may be preferred in some application circumstances but be less preferred in others.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An adjustable inside applicator including an attachment body to attach the applicator to a source of compound to be applied to a joint, the attachment body having a bore including an inlet and at least two outlets, a pair of application faces angularly disposed relative to one another with at least one outlet located in each of the pair of faces, and a pair of floating application guide heads mounted pivotably to the attachment body and a biasing mechanism provided between the attachment body and each of the floating application guide heads to bias each of the floating application guide heads towards a maximum angle between the respective floating application guide heads but each of the floating application guide heads is movable against the bias into an angle which is less than the maximum angle during application to abut an inside corner, each floating application guide head having an opening therein in communication with a respective at least one outlet of the body.

2. An adjustable inside applicator as claimed in claim 1 wherein the angle between the pair of application faces is greater than 90° but less than 180°.

3. An adjustable inside applicator as claimed in claim 1 wherein the angle between the pair of application faces is approximately 100°.

4. An adjustable inside applicator as claimed in claim 1 wherein the bore extending through the attachment body is unitary adjacent the inlet and divides into at least a pair of bore portions which each lead to an outlet from the attachment body.

5. An adjustable inside applicator as claimed in claim 1 wherein an external portion of the attachment body is provided with a mounting assembly in order to mount one or more biasing members in order to bias the floating application heads towards the maximum angle.

6. An adjustable inside applicator as claimed in claim 1 wherein the attachment body is provided with a hinge point at the end opposite the inlet to allow pivoting of the application guide heads about the hinge point.

7. An adjustable inside applicator as claimed in claim 1 wherein each of the floating application guide heads has an opening through the floating application guide head.

8. An adjustable inside applicator as claimed in claim 7 wherein the opening forms a bore through the floating application guide head with a continuous wall defining the bore.

9. An adjustable inside applicator as claimed in claim 8 wherein the bore of the respective application guide head communicates with a respective outlet in an application face of the attachment body with each outlet in the application face of the attachment body located within the bore through the floating application guide head.

10. An adjustable inside applicator as claimed in claim 7 wherein each opening in the floating application guide heads is located in a rebated portion of the floating application guide head.

11. An adjustable inside applicator as claimed in claim 10 wherein a pair of substantially parallel raised guide portions extends over each floating application guide head to define the rebated portion therebetween.

12. An adjustable inside applicator as claimed in claim 11 wherein the raised guide portions each typically have an abutment surface provided in order to abut a wall surface.

13. An adjustable inside applicator as claimed in claim 11 wherein the raised guide portions are squared off in order to restrain or provide a lateral limit of flow of compound exiting the outlet.

14. An adjustable inside applicator as claimed in claim 11 wherein respective ends of the rebated portion are open with lateral limits of the compound defined by the pair of raised guide portions.

15. An adjustable inside applicator as claimed in claim 12 wherein the abutment surfaces of each of the pair of guide portions are coplanar.

16. An adjustable inside applicator as claimed in claim 1 wherein the floating application guide heads are mounted to the attachment body at a hinge point allowing independent pivoting of the floating application guide heads about the hinge point.

17. An adjustable inside applicator as claimed in claim 12 wherein the floating application guide heads are movable between a maximum angle between the abutment surfaces of each of the pair of guide portions of almost 180°, and a minimum angle in which the rebated portion of the floating application guide heads is substantially coplanar with a respective application face of the attachment body.

18. An adjustable inside applicator as claimed in claim 17 wherein the minimum angle is approximately 100° and the maximum angle is approximately 160°.

19. An adjustable inside applicator including an attachment body to attach the applicator to a source of compound to be applied to a joint, the attachment body having a bore therethrough including an inlet and at least a pair of outlets, at least one outlet located in each of a pair of faces which are angularly disposed relative to one another, and a pair of floating application guide heads mounted pivotably to the attachment body and a biasing mechanism provided between the attachment body and each of the floating application guide heads to bias each of the floating application guide heads towards a maximum angle between the respective floating application guide heads but each of the floating application guide heads is movable against the bias into an angle which is less than the maximum angle during application to abut an inside corner, each floating application guide head having an opening therein in communication with a respective at least one outlet of the body.

* * * * *